US009093041B2

(12) United States Patent
Schmidt et al.

(10) Patent No.: US 9,093,041 B2
(45) Date of Patent: Jul. 28, 2015

(54) BACKLIGHT VARIATION COMPENSATED DISPLAY

(75) Inventors: John F. L. Schmidt, Phoenix, AZ (US); Victoria P. Haim, Glendale, AZ (US); Elias S. Haim, Glendale, AZ (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 1810 days.

(21) Appl. No.: 11/288,497

(22) Filed: Nov. 28, 2005

(65) Prior Publication Data

US 2007/0120806 A1 May 31, 2007

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 3/3655* (2013.01); *G09G 2320/0247* (2013.01); *G09G 2320/0257* (2013.01); *G09G 2320/0606* (2013.01); *G09G 2320/0626* (2013.01); *G09G 2360/145* (2013.01)

(58) Field of Classification Search
CPC ... G09G 3/3406; G09G 3/342; G09G 3/3426; G09G 3/36; G09G 2320/0646
USPC ..... 345/204, 87–104
See application file for complete search history.

(56) References Cited

U.S. PATENT DOCUMENTS 4,319,237 A * 3/1982 Matsuo et al. ..... 345/101
5,831,693 A * 11/1998 McCartney et al. ..... 349/42
5,914,764 A * 6/1999 Henderson ..... 349/161
6,447,132 B1 * 9/2002 Harter, Jr. ..... 362/29
6,452,582 B1 * 9/2002 Rolston ..... 345/102
6,521,879 B1 * 2/2003 Rand et al. ..... 250/205
6,831,621 B2 * 12/2004 Nakano ..... 345/87
7,154,468 B2 * 12/2006 Linzmeier et al. ..... 345/102
7,295,180 B2 * 11/2007 Ichikawa et al. ..... 345/102
7,468,721 B2 * 12/2008 Nakano ..... 345/102
2001/0008395 A1 * 7/2001 Yamamoto et al. ..... 345/102
2001/0013854 A1 * 8/2001 Ogoro ..... 345/102
2002/0011984 A1 * 1/2002 Shirochi et al. ..... 345/96
2002/0080127 A1 * 6/2002 Park et al. ..... 345/204

(Continued)

FOREIGN PATENT DOCUMENTS

JP 63243929 A * 10/1988

*Primary Examiner* — Alexander Eisen
*Assistant Examiner* — Nelson Lam
(74) *Attorney, Agent, or Firm* — Ingrassia Fisher & Lorenz, P.C.

(57) ABSTRACT

Methods and apparatus are provided for compensating a liquid crystal display for changes in brightness level. The apparatus comprises a variable brightness back-light optically coupled to a display panel whose properties depend upon back-light brightness. An electrical circuit measures back-light brightness and/or display flicker and sends this information to a controller. The controller automatically determines a display panel compensation signal based on back-light brightness and/or display flicker, and sends this compensation signal to the display panel to optimize the display panel properties for the commanded or observed back-light brightness level or flicker level so as to, for example, minimize display panel flicker and/or ghost image retention. Such automatic compensation is especially useful for head-up displays that must accommodate large variations in display brightness, e.g., from starlight to full sun, and/or for large, bright projection displays adapted to operate in different ambient light conditions where back-light brightness variation is desirable.

18 Claims, 7 Drawing Sheets

(56) References Cited

U.S. PATENT DOCUMENTS

| | | | | |
|---|---|---|---|---|
| 2003/0156087 | A1* | 8/2003 | Boer et al. | 345/92 |
| 2004/0095402 | A1* | 5/2004 | Nakano | 346/102 |
| 2004/0164943 | A1* | 8/2004 | Ogawa et al. | 345/92 |
| 2005/0041004 | A1* | 2/2005 | Gates et al. | 345/87 |
| 2005/0088102 | A1* | 4/2005 | Ferguson et al. | 315/149 |
| 2005/0140640 | A1* | 6/2005 | Oh et al. | 345/102 |
| 2005/0140641 | A1* | 6/2005 | Kim et al. | 345/102 |
| 2005/0190172 | A1* | 9/2005 | Koyama | 345/204 |
| 2006/0007091 | A1* | 1/2006 | Yang et al. | 345/89 |
| 2006/0055660 | A1* | 3/2006 | Teranishi | 345/102 |
| 2006/0109226 | A1* | 5/2006 | Tyrrell et al. | 345/98 |
| 2006/0125769 | A1* | 6/2006 | Ding | 345/102 |
| 2006/0146005 | A1* | 7/2006 | Baba et al. | 345/102 |
| 2006/0192748 | A1* | 8/2006 | Lowles et al. | 345/102 |
| 2006/0268180 | A1* | 11/2006 | Chou | 348/673 |
| 2006/0274022 | A1* | 12/2006 | Ohashi et al. | 345/102 |
| 2006/0279517 | A1* | 12/2006 | Shin et al. | 345/102 |
| 2007/0046485 | A1* | 3/2007 | Grootes et al. | 340/815.45 |
| 2007/0268241 | A1* | 11/2007 | Nitta et al. | 345/102 |
| 2008/0048967 | A1* | 2/2008 | Kamei | 345/102 |

* cited by examiner

-PRIOR ART-

-PRIOR ART-

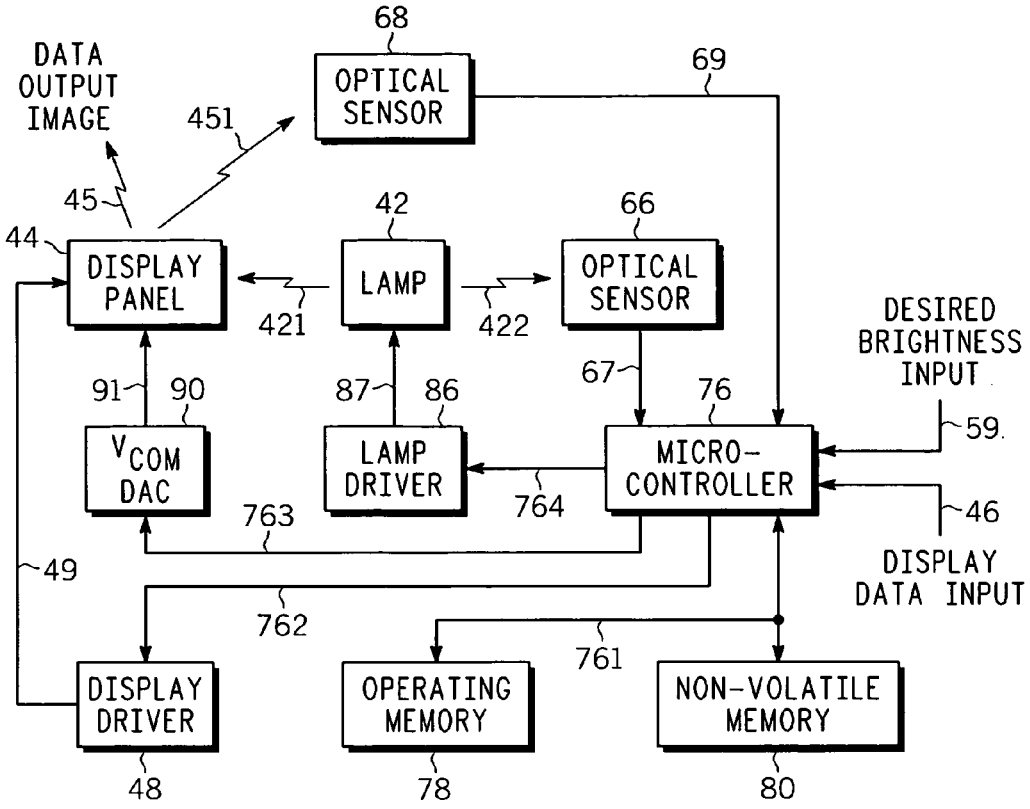
FIG. 6
FIG. 7
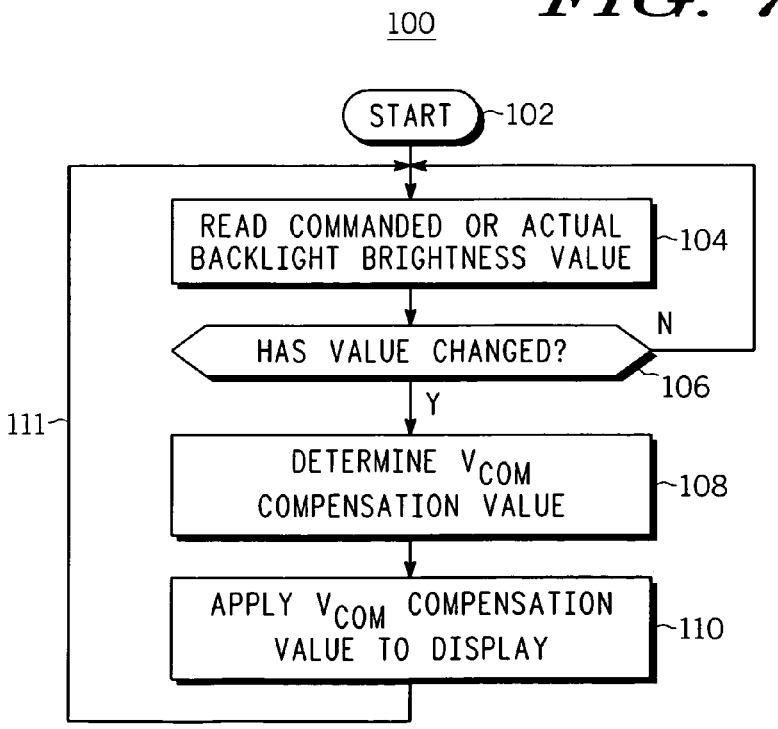

BACKLIGHT VARIATION COMPENSATED DISPLAY

TECHNICAL FIELD

The present invention generally relates to displays, and more particularly to head-up and projection displays compensated for variations in back lighting.

BACKGROUND

There are many applications today where it is desired to use flat panel displays, typically liquid crystal (LC) flat-panel displays (LCDs). For example, the display may be a head-up display (HUD) employed in an aircraft, that allows a user to view multiple scenes and/or multiple types of data at the same time without moving his or her head to look at different individual displays. With a HUD the aircraft pilot can see the scene outside of his or her cockpit window and at the same time view a variety of flight data overlaid on the image of the external scene. The pilot receives both types of information at the same time, the outside scene and the flight data, without having to glance down into the cockpit to view various flight data instruments. This is a significant advantage and can substantially improve pilot performance and safety. Head-up displays can be used in many other applications. Another example is a projection display where a back-light is directed through a flat panel LC display and the resulting image projected onto a screen in the viewer's line of vision. This arrangement is often used where a large size image is desired to be displayed. Both of these examples often need powerful back-lights to illuminate the LC display panel so that the resulting image can be easily seen against an outdoor scene in a head-up display or when enlarged many times in a projection display being viewed in significant ambient light, or both.

FIG. 1 illustrates typical prior art head-up display 20 that includes lamp 22 providing light beam 23 that illuminates liquid crystal display (LCD) panel 24 of variable transmittance. The desired display information or data is provided via input 26 to display driver 28, wherein it is converted to the proper signal format and sent along link 29 to drive display panel 24. Such arrangements are conventional. Data image 25 in optical form is emitted by display panel 24. Image 25 from display panel 24 passes through optional lens 30, which desirably provides focusing. Focused image 31 is projected on combiner plate 32 where it is partially reflected toward user 34 as image 33. Image combiner 32 is usually a partially reflecting, partially transmitting (e.g., glass) plate that is in user's line of vision 35. The user looks through combiner plate 32 at, for example, image 37 of external scene 36 and at the same time is able to see the data image 31, 33 that is being reflected off combiner plate 32. Elements 30-37 form optical portion 38 of display 20. For convenience of explanation it is assumed herein that image 37 results from an external scene, but this is not essential and not intended to be limiting. Image 37 may originate from any type of source. In many cases image 37 of external (or other) scene 36 can vary widely in brightness. In these circumstances, it is desirable that data image 31, 33 also be adjustable over a wide brightness range. Otherwise it may not be visible against a bright external scene (or other image). In order to achieve a wide brightness range for data image 25, 31, 33 being generated by display panel 24, it is often necessary that lamp 22 used to illuminate display panel 24 be very bright, for example, an order of magnitude or more brighter than lamps commonly employed with prior art LCD displays. It has been found that when such very bright lamps are used, the properties of typical LCD panels change with lamp brightness and undesirable artifacts such as flicker or a retained image can occur.

FIG. 2 illustrates typical projection display 20' that, other than optical portion 38' is substantially the same as display 20 of FIG. 1. Like reference numbers are used to identify like elements. Thus, elements 22-25 are substantially the same in FIG. 2 as in FIG. 1 and the discussion thereof in connection with FIG. 1 is incorporated herein by reference. Reference numbers with a prime (') mark are used to identify elements in optional portion 38' of FIG. 2 that perform functions analogous to those of elements in optical portion 38 of FIG. 1. Elements 30'-35' form optical portion 38'. In system 20' of FIG. 2, optical image 31' is projected by lens 30' onto projection screen or plate 32' that is located in line of sight 35' of viewer 34', so that viewer 34' can easily see image 33' from projection screen 32'. In this example, projection screen 32' is semi-transparent or translucent so that image 31', 33' is visible to viewer 34', but this is not essential. Viewer 34' may also be located on the same side of plate 32' as lens 30 and view the projected image by reflection. Either arrangement is useful. While the arrangement shown in FIG. 2 is useful and widely employed it suffers from a number of disadvantages well known in the art. For example, if there is significant ambient light around projection screen 32', then image 33' may be degraded or difficult to see. Further, where the area of image 31' must be very large, there is a rapid decrease in the intensity of image 31' seen by viewer 34'. For constant lamp brightness, the image intensity drops off approximately as the square of the image dimension. For example, doubling the image size reduces the brightness to about one-fourth of its original value. When projection displays have large screen size and/or must operate in significant ambient light or both, then very bright back-light lamps 22 are often used. It has been found that when such very bright lamps are used, the properties (e.g., flicker, retained image, etc.) of typical LCD display panels change with lamp brightness. When only a single brightness is needed, these artifacts can generally be compensated. But when variable brightness is needed, such prior art systems are unable to provide compensation over a range of brightness. This is undesirable. The brighter the lamp, the greater the need to provide a display system that adapts to back-light brightness variations.

Accordingly, it is desirable to provide an improved display that permits significant variations in brightness while compensating its output for such variations so as to maintain substantially optimized properties over such range of brightness. In addition, it is desirable that the compensation arrangement be electronic rather than mechanical so as to not cause a significant increase in weight or size of the display. Furthermore, other desirable features and characteristics of the present invention will become apparent from the subsequent detailed description and the appended claims, taken in conjunction with the accompanying drawings and the foregoing technical field and background.

BRIEF SUMMARY

A liquid crystal display is provided having compensation for varying brightness levels. According to a first exemplary embodiment, the display comprises, a dimmable back-light adapted to provide varying back-light brightness levels, a display panel optically coupled to the back-light for receiving illumination therefrom and whose properties depend upon the varying back-light brightness level, and having a first input for receiving a compensating signal, an electrical circuit for receiving back-light brightness level information, a non-volatile memory for storing values of an optimum display panel compensating signal as a function of the back-light brightness level information, and a controller coupled to the memory, the electrical circuit and the display panel, for retrieving from the memory the optimum display panel compensating signal corresponding to the back-light brightness level information received from the electrical circuit, and transmitting such optimum display panel compensating signal to the first input.

According to a second exemplary embodiment, the display comprises, a dimmable back-light adapted to provide varying back-light brightness levels, a display panel, optically coupled to the back-light for receiving illumination therefrom and whose flicker properties depend upon the varying back-light brightness level, and having a first input for receiving a compensating signal, an electrical circuit for receiving a real time display panel flicker level, and a controller coupled to the electrical circuit and the display panel, adapted to receive from the electrical circuit a signal related to the display flicker level and determine based thereon a display panel compensating signal corresponding to the observed display panel flicker level and transmit such display panel compensating signal to the first input.

A method for compensating a liquid crystal display for varying brightness levels is provided. The method comprises, reading a commanded or actual brightness value, determining a display compensating signal value corresponding to the read brightness value, and automatically applying the compensating signal level to the display. According to a still further exemplary embodiment, the method comprises, sensing the real time display flicker, determining a display compensating signal value corresponding to the sensed display flicker, and automatically applying the compensating signal value to the display to reduce said flicker.

Such automatic brightness compensation is especially useful for head-up displays that must accommodate large variations in display brightness, e.g., from starlight to full sun, and/or for large, bright projection displays adapted to operate in different ambient light conditions where back-light brightness variation is desirable.

BRIEF DESCRIPTION OF THE DRAWINGS

The present invention will hereinafter be described in conjunction with the following drawing figures, wherein like numerals denote like elements.

FIG. 6 is a simplified schematic block diagram of the electrical and light emitting portions of the display of FIGS. 4 and 5, showing further details and according to a still further exemplary embodiment of the present invention;

FIG. 7 is a flow chart illustrating a method according to an additional exemplary embodiment of the present invention.

DETAILED DESCRIPTION

Figure 1:
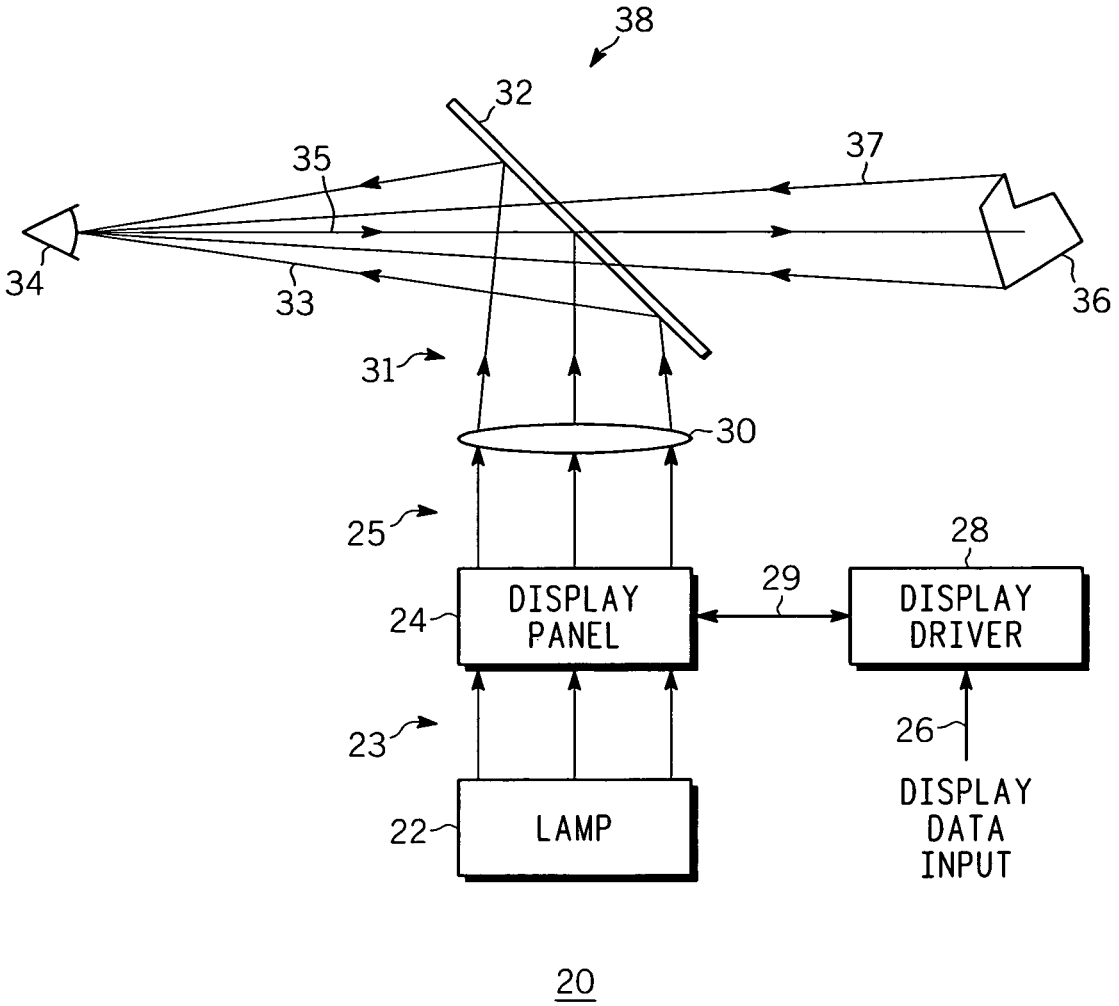
FIG. 1 is a simplified schematic block diagram of a head-up display according to the prior art.
Figure 2:
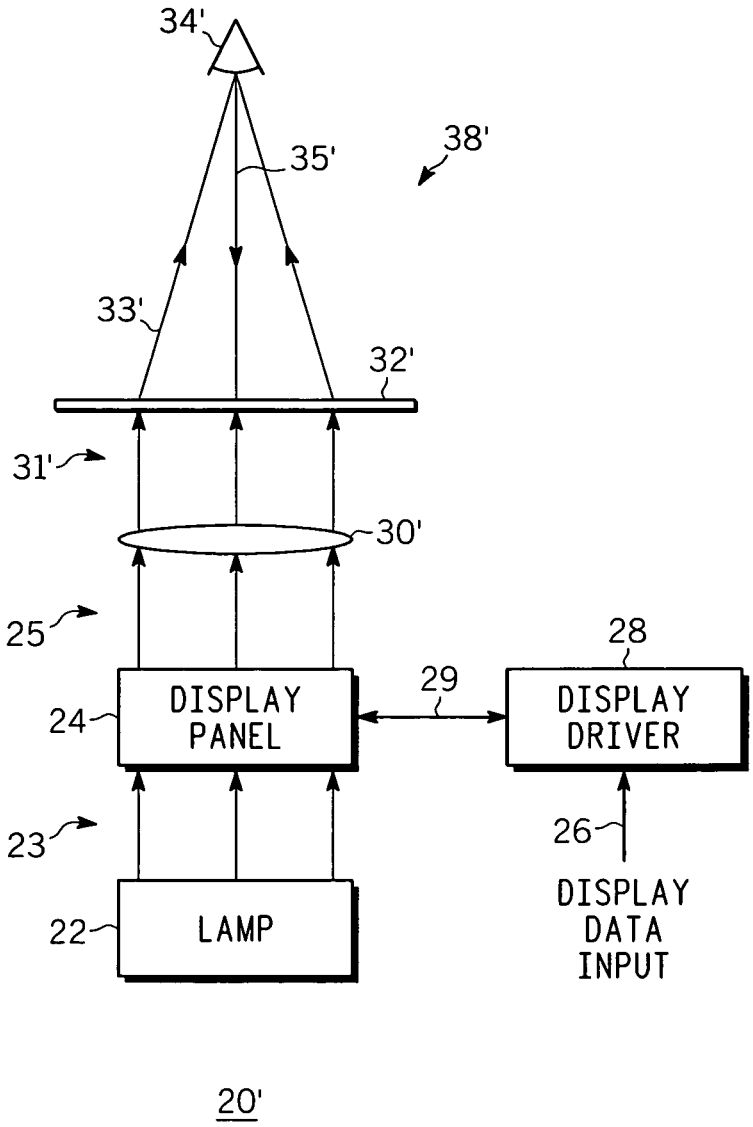
FIG. 2 is a simplified schematic block diagram of a projection display according to the prior art.

The following detailed description is merely exemplary in nature and is not intended to limit the invention or the application and uses of the invention. Furthermore, there is no intention to be bound by any expressed or implied theory presented in the preceding technical field, background, brief summary or the following detailed description. As used herein, the words "data" and "information" are intended to include any type of data and/or information desired to be presented on a head-up or projection display and not be limited merely to parameters associated with aircraft or other vehicles. Non-limiting examples are digital and/or analog instrument read-outs, map information, navigational information, radar information, and system and/or sub-system status information, targeting and/or tracking information, vehicle operating information, fuel status, entertainment information, movies, sports information, play action, and so forth. The word "vehicles" is intended to include any type of conveyance, as for example but not limited to, airborne devices, wheeled or tracked transport, ships, boats, and so forth, powered or un-powered. As used herein the word "aircraft" is intended to be an exemplary form of vehicles to which the present invention applies and is not intended to be limiting. The word "lamp" is intended to include any form of light source whose output can be electrically adjusted. The term "non-volatile memory" is intended to mean any mechanism to permanently store information or data for later retrieval and use, and not be limited to merely electronic components. Non-limiting examples of non-volatile memory include FLASH memory, EEPROM memory, and PROM memory, but may also include programmed constants stored in program memory, or device loadable firmware, such as can be developed using programmable logic source code, or embedded software source code. Non-volatile memory may also include constants that can be read or determined in real time by a processing unit. For example, resistor values, voltages, or currents can be used to hold operational values for later processing. The words "controller" and "microcontroller" as used herein, are intended to include a control block function capable of sensing inputs, performing calculations or computations on the input signal values and values retrieved from memory, and generating outputs whose values depend on the input signal values and the calculations or computations that have been performed on those input values and, optionally, also on values retrieved from memory, thereby generating output signals. The word "flicker" as used herein, is intended to describe a rapid temporal variation in display luminance. The word "retained image" as used herein, means an undesired afterimage that persists on the display after the drive is removed.

In the past, liquid crystal projection and head-up displays have generally employed fixed brightness light sources, such as high pressure light bulbs, but it is difficult or impossible to dim such high intensity bulbs without significant undesirable color change. Recent advances in light emitting diodes (LEDs) have made it possible to employ LED arrays as high intensity light sources (back-lights) for large screen television, portable projector units, avionics projection and head-up displays. LED light sources easily accommodate wide dynamic range dimming. Thus, with the availability of suitable LEDs, wide dynamic dimming range display systems can be built. They will also have longer lamp life as well as easy brightness adjustment to accommodate varying ambient light levels where those products are used. The present invention finds particular utility in projection and head-up display systems where substantial dimming capability is desired.

Figure 3:
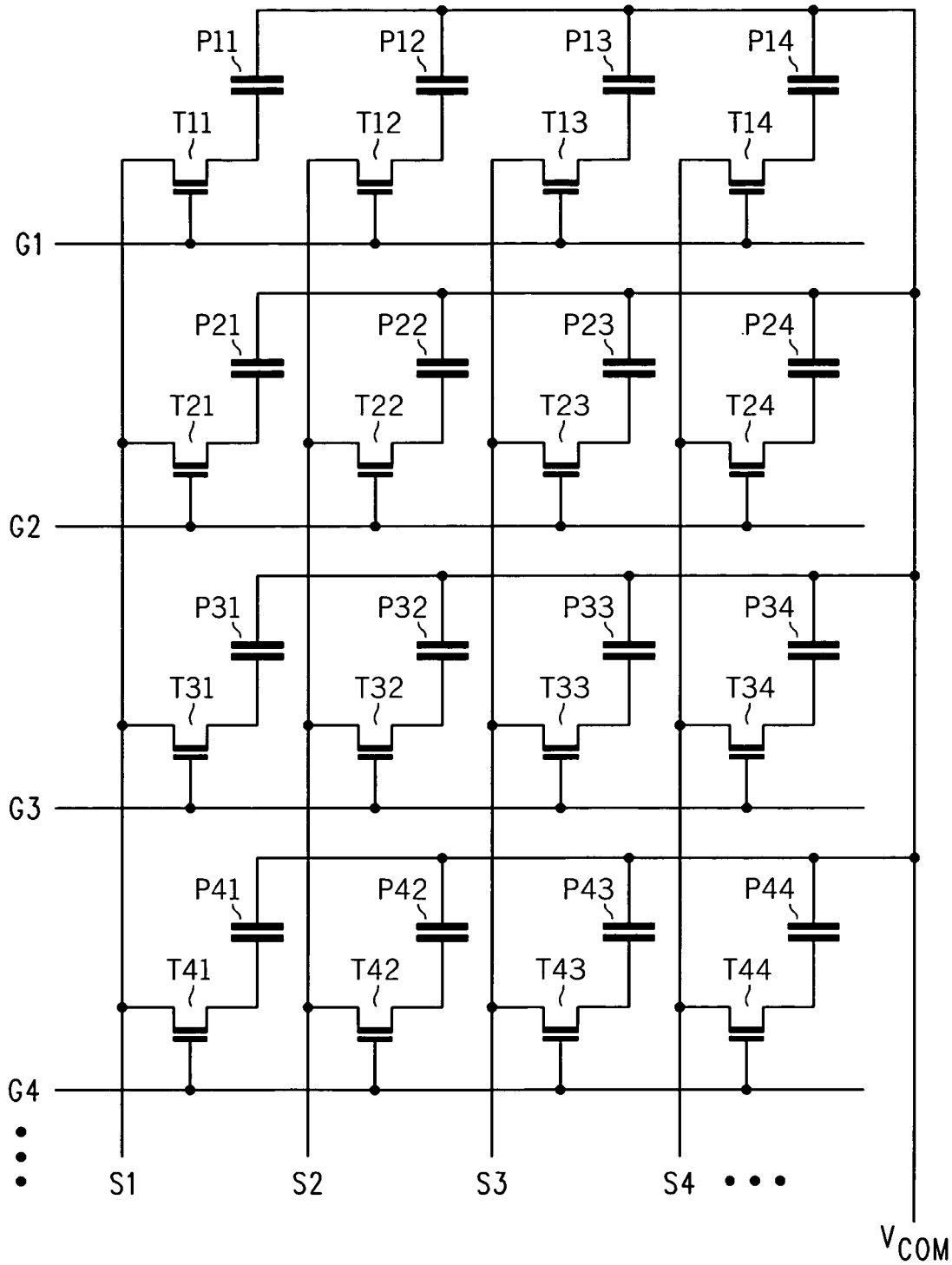
FIG. 3 is a simplified electrical equivalent circuit of a portion of a liquid crystal display (LCD) panel useful in a head-up and/or projection display.

FIG. 3 is a simplified electrical equivalent circuit of a portion of liquid crystal display (LCD) panel 38 useful in a head-up and/or projection display, illustrating the electrical arrangement of the various elements of the panel. Panel 38 comprises an x-y array of thin film transistors (TFTs) $T_{11} \ldots T_{RC} \ldots T_{MN}$, each coupled to an individual liquid crystal (LC) pixel $P_{11} \ldots P_{RC} \ldots P_{MN}$, where "R" and "C" stand for "row" and "column" respectively, and "M" and "N" are the maximum values of R and C respectively. For convenience of illustration M=N=4 in FIG. 3, but this is not intended to be limiting and M and N may have any convenient values. In each row of the display, the gates of TFTs $T_{R1} \ldots T_{RN}$ are coupled to gate line $G_R$ where $G_R$ can take on the values $G_1 \ldots G_R \ldots G_M$. In each column of the display, the sources of TFTs $T_{1C} \ldots T_{MC}$ are coupled to source line $S_C$ where $S_C$ can take on the values $S_1 \ldots S_C \ldots S_N$. In each row and column, the drain of each TFT $T_{RC}$ is coupled to one electrode of individual LC pixel $P_{RC}$, whose opposite electrode is coupled to common DC voltage electrode $V_{COM}$. LC pixels are desirably driven with AC voltages applied to the $G_R$ and $S_C$ lines, and whose magnitude is inversely proportional to the desired brightness for a normally white display, or proportional to brightness for a normally black display. Furthermore, each gate line $G_R$ is independently driven by an output from a gate driver circuit, wherein said gate driver comprises a large scale integrated circuit device coupled to display panel 38 by means well known in the art. Such gate driver circuit receives at its inputs power supply voltages, and timing control signals synchronized to the source driver chip timing control signals, thereby enabling the independent addressing of each $T_{RC}$. Furthermore, each source line is independently driven by an output from a source driver circuit coupled to display panel 38 by means well known in the art. Such source driver circuit receives at its inputs power supply voltages, timing control signals synchronized to the gate driver timing control signals, data representing the desired luminous intensity for each programmed $T_{RC}$ and a set of DC voltages, called gamma voltages that define the LCD panel's brightness versus voltage transfer characteristics. The gamma voltages are symmetrically paired to ensure the LCD is properly driven with a balanced voltage waveform which possesses a root-mean-square (RMS) voltage value, but no DC voltage value. One gamma voltage of the symmetric pair drives the LCD to a voltage above $V_{COM}$, and the alternate gamma voltage drives the LCD to a voltage below $V_{COM}$ by the same magnitude as its paired voltage. The other gamma voltage pairs operate in a like fashion. Many commercially available source drivers employ between 5 and 8 symmetrically paired gamma voltages (10 to 16 gamma voltage inputs). Each gamma voltage pair is applied at a discrete point along the source driver's built-in gamma voltage profile. Wherein the source driver internally defines the available LCD voltages between any two consecutive gamma voltages, the gamma voltage inputs are presented to the system, to allow changes to the system brightness versus voltage transfer characteristics at fixed locations in the brightness versus voltage curve. Commercial source drivers typically provide from 64 intensity levels to 256 intensity levels for each display pixel (or dot of a three-dot color pixel), where each pixel (or dot of a three-dot color pixel) is independently driven by a single source driver output pin. DC voltage $V_{COM}$ can be used to offset certain operating interactions between the applied (data carrying) AC voltage and the TFT array. It has been found that by adjusting $V_{COM}$, the apparent flicker and retained image presented by LCD panel 38 can be minimized. Usually, $V_{COM}$ is set to optimize the performance of panel 38 for a particular flicker pattern and backlight brightness. In the past, once this was done, $V_{COM}$ was then never changed unless there were extenuating circumstances. For example, if a backlight was changed, $V_{COM}$ would need to be re-optimized, otherwise it was left unchanged.

In the course of developing display systems useful where a wide range of back-light brightness must be accommodated (e.g., for aircraft HUDs, large screen displays, etc.) it was discovered that the properties of typical TFT panels changed with backlight brightness and that a single optimization of $V_{COM}$ was not useful. This is believed to be due to the fact that the TFTs are mildly photo-sensitive and that their properties can change with backlight brightness at high illumination levels. In ordinary displays this photosensitivity is not troublesome, because the backlights themselves are comparatively weak and do not scatter sufficiently within the TFT and LC pixel array to cause problems. But, with the 10-12 times increase in backlight intensity needed to create displays capable of handling large ranges of, for example forward scene or ambient brightness associated with cockpit and large displays, it was found that as the HUD back-light is controlled from minimum brightness (e.g., for starlight viewing) to maximum brightness (e.g., for full sunlight viewing), the value of $V_{COM}$ needed to optimize display performance varies widely. Similarly, with projection displays intended to adjust, for example, to large variations in ambient lighting, the required changes in back-light brightness caused the value of $V_{COM}$ needed to optimize display performance to also vary widely. It was found that it was not practical to use fixed values of $V_{COM}$ to adequately compensate for back-light variations ranging from 2 to 1 for high brightness to more than 50,000 to 1. As used herein, the term "significant brightness (or dimming) variation" is intended to include brightness variation (or dimming) of about 2 to 1, or greater.

In a first exemplary implementation, $V_{COM}$ is dynamically changed as a function of back-light lamp brightness, thereby overcoming this problem and providing significantly improved displays that are back-light compensated over a wide with range of back-light brightness. For example, it was found that with the present invention, back-light variations ranging from 2 to 1 to as much as 50000 to 1 could be adequately compensated using the arrangement and method of the present invention. Thus, the present invention is especially useful, for example and not intended to be limiting, in connection with liquid crystal head-up displays, with liquid crystal projection displays used in big screen televisions and data or status displays, with table-top liquid crystal display projectors, with avionics liquid crystal display projection systems, and other systems or displays that must provide a significant range of back-light lamp dimming capability.

Figure 4:
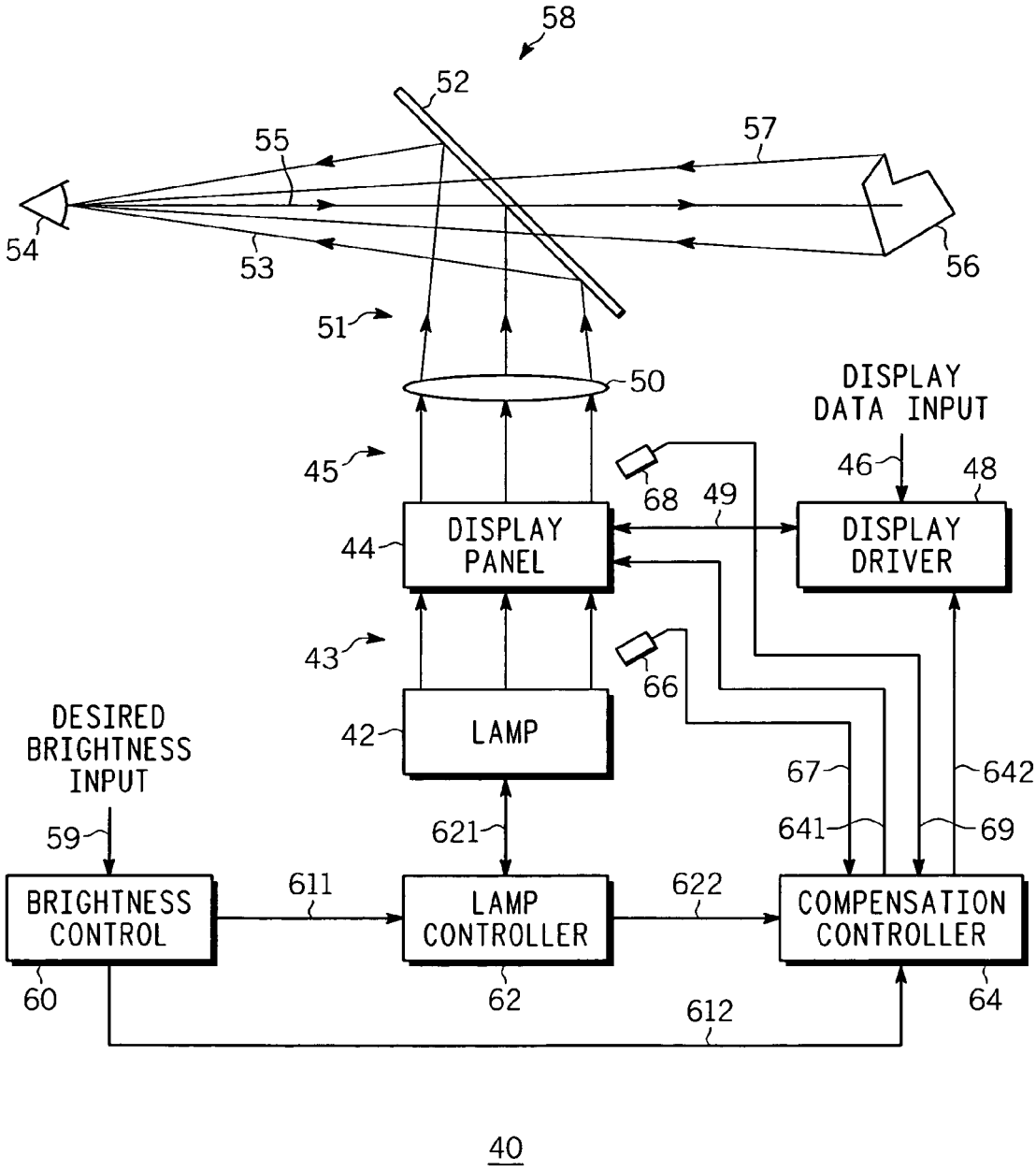
FIG. 4 is a simplified schematic block diagram of a head-up display according to an exemplary embodiment of the present invention.

FIG. 4 is a simplified schematic block diagram of head-up display (HUD) 40 according to an exemplary embodiment of the present invention. HUD 40 comprises lamp 42 emitting light 43, LC display panel 44, preferably a thin-film-transistor (TFT) type of LC display panel analogous to panel 38 of FIG. 3 that emits data image 45, display driver 48 receiving display data input 46 and transmitting the appropriate row and column signals via link 49 to display panel 44, lens system 50 for focusing output data image 51, and combiner 52 for receiving data image 51 from lens 50 and sending reflected data image 53 to viewer 54 along viewer line of sight 55. Scene 56 provides image 57 via combiner 52 to viewer 54, also along viewer line of sight 55. Elements 50-57 make up display optical portion 58. Elements 42-58 are generally analogous to elements 22-38 of FIG. 1 but, as will be subsequently explained, differ in some respects so as to provide the compensation function according to the present invention. HUD 40 further comprises user desired brightness input 59 to brightness control 60, whereby a viewer can adjust the back-light brightness of HUD 40 to suit his needs, ranging for example from starlight to full sun viewing situations. Brightness control 60 is coupled by link 611 to lamp controller 62 in order to communicate the desired backlight brightness to lamp controller 62. Lamp controller 62 is coupled by link 621 to lamp 42 and serves to vary the optical emission from lamp 42 in response to commands or settings received via input 59. HUD 4Q further desirably comprises compensation controller 64 which, for example, adjusts $V_{COM}$ for display panel 44 via link 641 to panel 44, in response to changes in actual brightness or brightness commands or settings.

Any means of determining lamp brightness may be used. For example, compensation controller 64 may determine lamp brightness by: (i) receiving a signal proportional to the commanded brightness from brightness control 60 via link 612, or (ii) receiving a signal proportional to commanded lamp current or voltage via link 622 from lamp controller 62 or (iii) receiving a signal proportional to actual lamp output via link 67 from photocell or other optical pick-up 66, or (iv) receiving a signal proportional to display panel brightness (or flicker) from photocell or other optical pickup 68. Any one or a combination of these arrangements is useful. Photocells or optical pickups 66, 68 are conveniently coupled to compensation controller 64 by links 67, 69 respectively. Use of photocell or optical pick-up 66, 68 has the advantage that lamp aging is automatically taken into account. While HUD 40 of FIG. 3 shows photocell or optical pick-up 66, 68 as being separate from display panel 44, this is merely for convenience of explanation and is not essential. Optical pick-up or photocell 66, 68 may be built into panel 44. For example, a separate photo-transistor may be provided on or in panel 44 or use may be made of one or more of the photo-sensitive TFTs in panel 44, to obtain an output proportional to the actual brightness of lamp 42 or the flicker of panel 44. Any and all of these arrangements are useful. What is important is that compensation controller 64 has an input proportional to lamp brightness (or display flicker) so that it can adjust the properties of display panel 44 to compensate for variations in lamp brightness (or display flicker). As noted earlier, it may compensate panel 44 by adjusting $V_{COM}$ via link 641. While optimizing performance of display panel 44 by adjusting $V_{COM}$ is particularly convenient, it is not the only means for doing so and display panel 44 may also be compensated in whole or in part by adjusting (e.g., using link 642) the AC drive provided by display driver 48 and/or by providing supplementary DC signals to gate signal leads $G_R$ and/or source signal leads $S_C$ alone or in combination with adjustments to $V_{COM}$. Either arrangement is useful.

Figure 5:
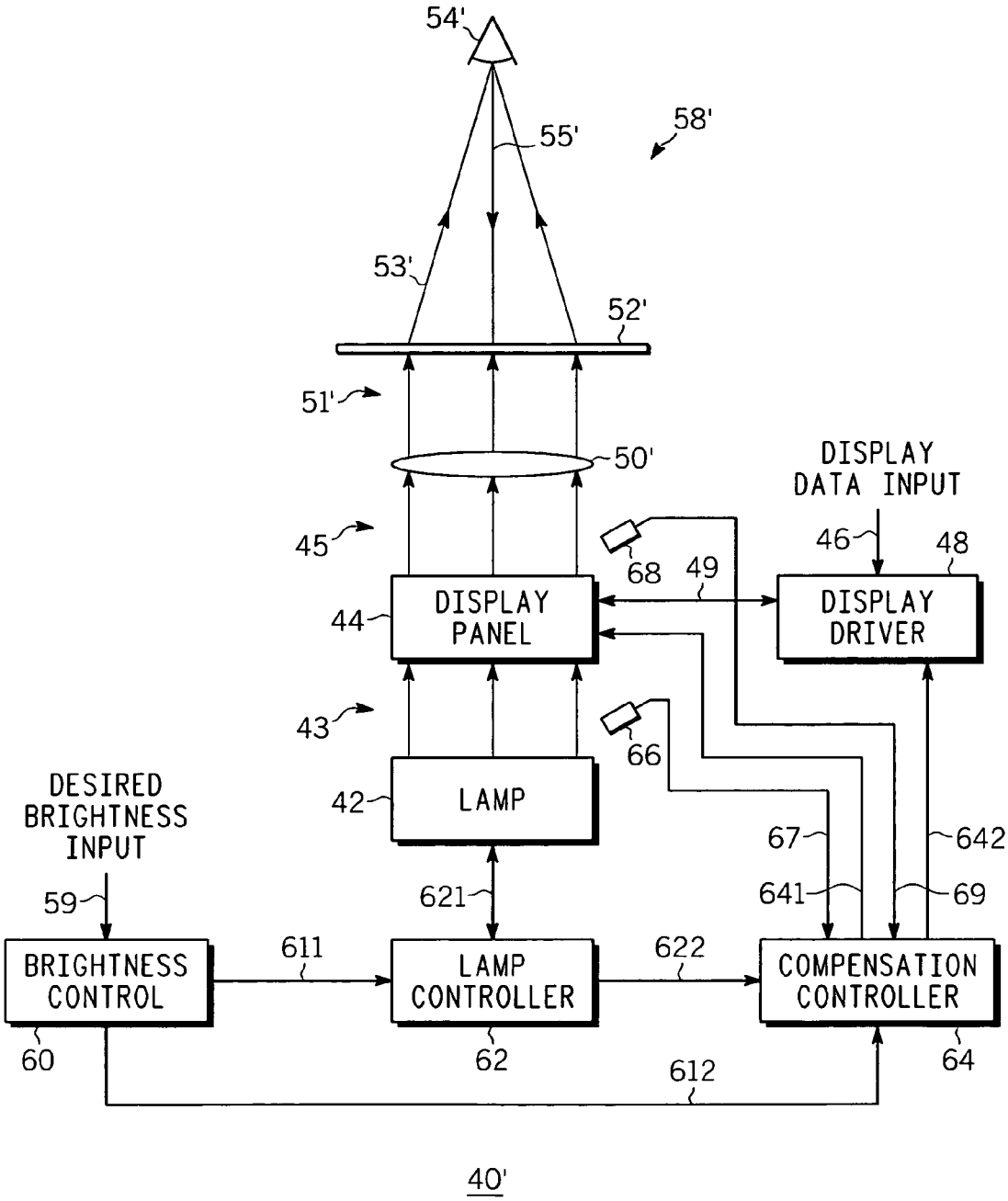
FIG. 5 is a simplified schematic block diagram of a projection display according to a further exemplary embodiment of the present invention.

FIG. 5 is a simplified schematic block diagram of projection display 40' according to a further exemplary embodiment of the present invention. Like reference numbers are used to identify like elements. Thus, elements 42-68, inputs 46, 59 and coupling links 49, 67, 69, 611, 612, 622, 641, 642 are substantially the same in FIG. 5 as in FIG. 4 and the discussion thereof in connection with FIG. 4 is incorporate herein by reference. Reference numbers with a prime (') mark are used to identify elements in optional portion 58' of FIG. 5 that perform functions analogous to those of elements in optical portion 58 of FIG. 4. Elements 50'-55' form optical portion 58'. Displays 40 and 40' of FIGS. 4 and 5, respectively, differ only in display optical portions 58, 58'. In display 40 of FIG. 4, optical portion 58 is adapted for a head-up display, while in display 40' of FIG. 5, optical portion 58' is adapted for a projection display. Optical portion 58' receives optical image 45 from display panel 44, passes it through lens 50' to projection screen or plate 52' located in viewer's line of sight 55' so that viewer 54' receives focused image 53' from projection screen or plate 52'. In FIG. 5, viewer 54' is shown as being on the far side of projection screen or plate 52' but this is only convenience of explanation and not intended to be limiting. Projection plate 52' may be reflective, in which case viewer 54' can be located on the same side of projection plate 52' as lens 50'. Either arrangement is useful. In the same manner as has already been discussed in connection with display 40 of FIG. 4, display 40' of FIG. 5 provides automatic adjustment of $V_{COM}$ to dynamically compensate display panel 44 for variations in commanded and/or actual brightness of back-light lamp 42. This substantially improves performance of projection displays that must accommodate significant variations in back-light brightness to adjust for changes in ambient lighting and/or projected image size.

FIG. 6 is a simplified schematic block diagram of electrical system 70 of head-up display 40 of FIG. 4 and projection display 40' of FIG. 5, showing further details according to a still further exemplary embodiment of the present invention. Like reference numbers have been used to identify like elements. System 70 comprises microcontroller 76, memory 78, 80, display driver 48, lamp driver 86, $V_{COM}$ digital-to-analog converter (DAC) 90, optional optical sensors 66, 68, lamp 42 and LCD display panel 44. Microcontroller 76 receives display data input via link 46 and desired brightness input via link 59 and, optionally, actual lamp brightness from optional optical sensor 66 via link 67 and/or display flicker from optional optical sensor 68 via link 69. Microcontroller 76 is coupled via bus 761 to operating memory 78 and to non-volatile memory 80. Operating memory 78 is conventional. Microcontroller 76 is further coupled to display driver 48 via link 762 and from there to display panel 44 by link 49. Microcontroller 76 in cooperation with display driver 48 causes the appropriate pixel dots in display panel 44 to become transparent or opaque so that the information represented by display data input 46 is transferred to optical image 45 produced by display panel 44. Microcontroller 76 is also coupled to lamp driver 86 via link 764. Lamp driver 86 is coupled to lamp 42 via link 87. In a first mode of operation of the exemplary implementation illustrated in FIG. 6, microcontroller 76 receives the desired brightness input via link 59, determines the appropriate drive current (or voltage) to cause lamp 42 to provide the desired brightness level and sends a corresponding signal over link 764 to lamp driver 86 which, in turn, provides the specified current (or voltage) to lamp 42 over link 87. In a second mode of operation, microcontroller 76 in addition to the desired brightness receives display flicker information via link 69 from sensor 68 and determines therefrom an appropriate correction signal to provide via link 762 to display driver 48. In this manner, the functions of blocks 60, 62 of FIGS. 4-5 are being carried out by microcontroller 76 in cooperation with lamp driver 86. Lamp 42 provides light 421 to LCD display panel 44 which in turn emits data image 45 toward lens 50, 50' (see FIGS. 4-5). Optionally, portion 451 of data image 45 may be coupled to optional optical sensor 68, which is in turn desirably coupled to microcontroller 76 by link 69. Lamp 42 may also provide light portion 422 to photocell or other optical sensor 66, but this is not essential. Optical sensor 66 may also be used in conjunction with microcontroller 76 as a feedback loop for control of the brightness of lamp 44, but this is not essential.

Non-volatile memory 80 is used to store program instructions for microcontroller 76 and, conveniently, to store a look-up table or other data relating commanded or actual lamp brightness values (or equivalent) to the values of $V_{COM}$ (or other display drive voltages) needed to compensate display panel 44 for different brightness levels of lamp 42. It has been determined that a single valued, monotonic functional relationship exists between lamp brightness values and $V_{COM}$ values for optimal compensation of TFT LC panels useful in head-up and projection displays. Persons of skill in the art will understand how to go about determining such relationships for the particular combination of lamps and panels they desire to use. Such relationships can be easily stored in non-volatile memory in the form of look-up tables wherein entering a given actual lamp brightness or commanded lamp brightness or commanded lamp current or voltage (depending upon which input is being used) yields the optimal $V_{COM}$ value for such lamp brightness, current, voltage, etc. Such data is most conveniently stored in memory 80 and manipulated by microcontroller 76 in digital form. Accordingly, the digital $V_{COM}$ value retrieved from memory 80 in response to a particular brightness input is conveniently converted from digital to analog form in $V_{COM}$ DAC 90 coupled to microcontroller 76 via link 763 and then sent to display panel 44 via link 91. It will be noted that system 70 not only allows the brightness of optical output 45 from display panel 44 of HUD 40 to be adjusted as desired, but also automatically optimizes the compensation of display panel 44 for such changing brightness levels. This is a significant improvement. The functions of compensation controller 64 of FIG. 3 are being handled by microcontroller 76 in combination with $V_{COM}$ DAC 90. Persons of skill in the art will also understand that display driver 48 can, alternatively, be incorporated with microcontroller 76, but this is not essential. In a further mode of operation, LCD flicker can be dynamically sensed in real time using optional optical sensor 68 picking up portion 451 (or equivalent) of output 45 of display panel 44. Real time compensation (e.g., by adjusting $V_{COM}$) can then be applied to display panel 44 via microcontroller 76 coupled to $V_{COM}$ DAC 90 and/or display driver 48, either singly or in combination, so as to minimize the real-time flicker. Either arrangement is useful.

It is known to those skilled in the art that a liquid crystal display panel's brightness versus drive voltage transfer function is determined by: (i) the liquid crystal material properties, (ii) the applied alternating polarity voltage magnitude possessing a fixed root-mean-square (RMS) value, and (iii) by the column driver gamma profile, which may be fixed by internal digital-to-analog converters, or by resistive ladders. Liquid crystal material responds favorably to symmetrically applied alternating voltage (AC voltage), and likewise, responds unfavorably to a direct voltage (DC voltage) applied across the liquid crystal material via the TFT's coupled in series with the LCD pixels. When an asymmetrical voltage is applied across the liquid crystal material, it produces a net DC voltage, which contributes to the retained image and also produces display flicker. The column driver gamma profile provides discrete inputs where fixed voltages may be applied, thereby altering the gamma profile. Of the total gamma voltage set, one half are used for positive polarity voltages, and the other half are used to generate negative polarity voltages, where the positive and negative polarities are symmetric with respect to a reference voltage sometimes referred to as the center voltage. Due to the parasitic capacitive element in the TFT, the pixel voltage is always lower than the desired programming voltage by an offset voltage called delta-V. The common electrode voltage, $V_{COM}$, is adjusted to negate the effects of delta-V, thereby minimizing display flicker. While it is possible to change $V_{COM}$ directly, it is also possible to change $V_{COM}$ indirectly, by changing the gamma voltages. The Gamma voltages comprise a set of DC voltages, usually ten to sixteen in number, whose monotonic increasing values are applied to the source or column drivers to set the LCD panel's brightness versus voltage transfer curves. Each gamma voltage is applied to a corresponding voltage input pin on the column drivers, and all congruent pins of the column drivers are driven in parallel. A typical set of Gamma voltages would be selected such that the average voltage between any two matched Gamma voltages would be a constant. For example, if Gamma voltage level 0 is 13.2V and Gamma voltage level 15 is 0.3V, the center voltage is 6.75V. The remaining symmetric Gamma voltage pairs would likewise produce a center voltage of 6.75V in this example. To change the effective $V_{COM}$ voltage, the symmetric Gamma voltage pairs can be dynamically programmed, as a function of backlight brightness, to produce a changing center voltage profile as a function of backlight brightness. For example, if Gamma voltage level 0 is increased to 13.3V and Gamma voltage level 15 is increased to 0.4V, the center voltage will increase to 6.85V from 6.75V. The 0.1V change in center voltage is equivalent to changing $V_{COM}$ directly by 0.1V.

It is known that liquid crystal displays can be driven with a plurality of inversion methods, such as for example, pixel inversion, frame inversion, and column inversion. For each inversion method, each display pixel should be optimally driven with a voltage of positive polarity for alternating video frames, and negative polarity for the other video frames. These voltages should be symmetrical to achieve good display performance; that is to minimize both retained image and display flicker. As the voltage drive becomes asymmetrical, a DC voltage bias develops across the LCD. This DC voltage bias adversely impacts display performance, causing both flicker and retained image. Display flicker presents itself in a plurality of ways depending on the inversion method and the magnitude of the DC bias voltage. Flicker can be perceived as a shimmering or scintillating display, a pulsing or strobing display, or it can produce a washed out appearance. Flicker can be detected visually, or with optional photo-sensor 68 of FIG. 6. Flicker magnitude can be minimized by adjusting $V_{COM}$ to an optimum value. Microcontroller 76 receives an input voltage or other signal proportional to the flicker from sensor 68 via link 69, and applies flicker reduction method 200 of FIG. 8 using, for example, a fixed profile stored in non-volatile memory 80, or using a deterministic, dynamically calculated $V_{COM}$ value in conjunction with operating memory 78.

FIG. 7 is a flow chart illustrating method 100 according to a further exemplary embodiment of the present invention. Method 100 begins with START 102 and initial step 104 wherein system 70 reads the commanded brightness level received via link 59 (or a signal related thereto), or the actual brightness level received via link 67, depending which parameter is being used. This value can be temporarily stored in memory 78 or 80. Optional query 106 is then executed to determine whether the value read in step 104 has changed from the last value, also stored in memory 78 or 80. If the answer is NO (FALSE) then method 100 loops back to START 102 and initial step 104 and remains in this loop until the outcome of query 106 is YES (TRUE). When the outcome of query 106 is YES (TRUE) or option query 106 omitted, then method 100 advances to step 108 wherein the value of $V_{COM}$ needed to properly compensate display panel 44 for the value of commanded or measured back-light brightness read is step 104 is determined, for example, by use of a look-up table or other data or algorithms or both stored in memory 80. In step 110, the value of $V_{COM}$ retrieved from or calculated based on data in memory 80 is then sent to or applied to display 44, thereby providing optimal compensation for the commanded and/or observed display brightness value. Method 100 then returns to START 102 as shown by path 111 and awaits a further change in the commanded and/or actual display brightness.

Figure 8:
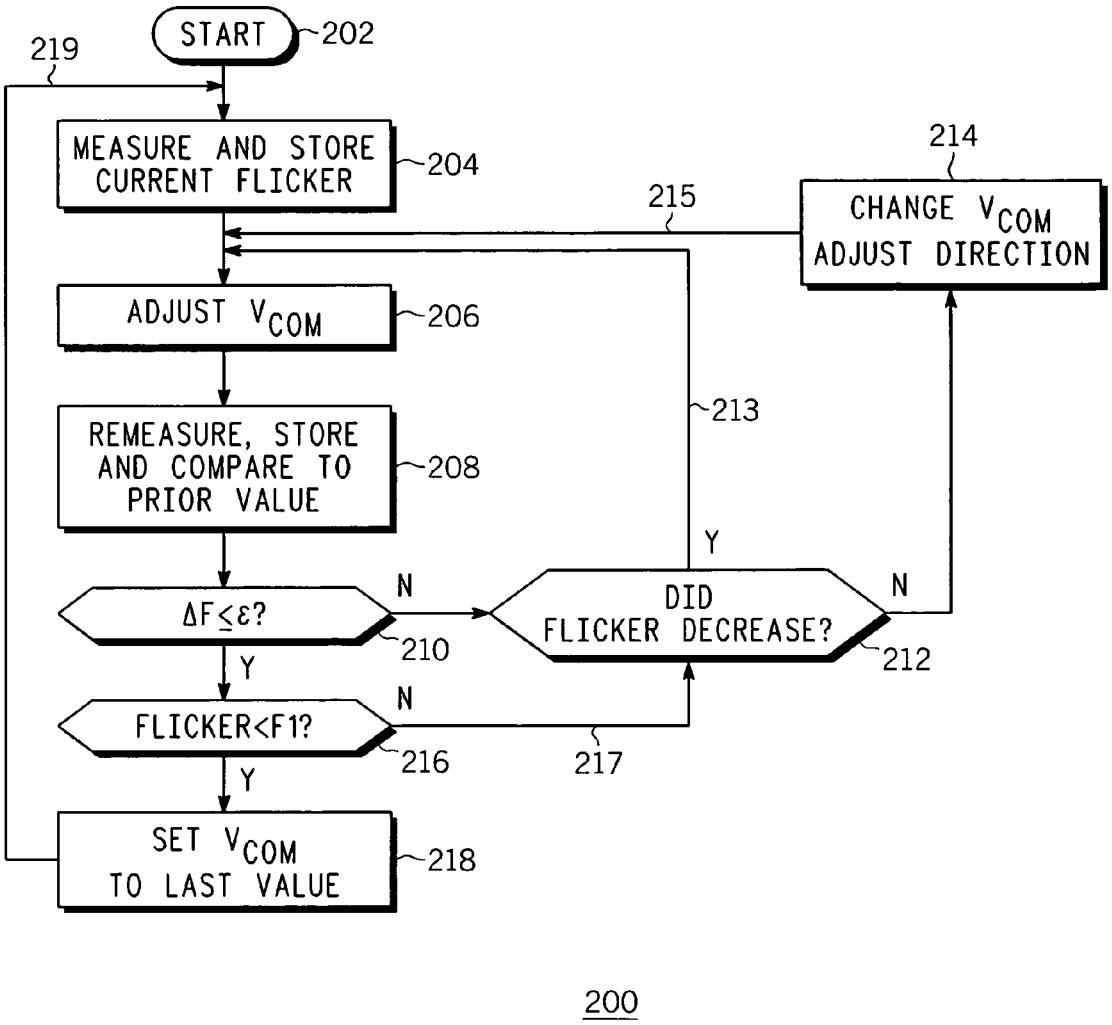
FIG. 8 is a flow chart illustrating a method according to a yet further exemplary embodiment of the present invention.

FIG. 8 is a flow chart illustrating method 200 according to a yet further exemplary embodiment of the present invention. Method 200 begins with START 202 and initial step 204 wherein system 70 reads the display flicker level (or a signal related thereto), e.g., using sensor 68, that is transmitted via link 69 to microcontroller 76 and stores the result in memory 78 or 80. $V_{COM}$ is adjusted in block 206, either upward or downward, and in block 208 the flicker magnitude is re-measured, stored and compared to the previous value obtained and stored in step 204. Query 210 determines whether or not the change in flicker $\Delta F$ is less than or equal to a small pre-determined stored value $\epsilon$, that is, $\Delta F \leq \epsilon$. The parameter $\epsilon$ can have any value equal or greater to zero depending upon how closely the user or designer wishes the system to converge on a minimum flicker value. The smaller the value, the more closely the system will approach a minimum flicker value. If the outcome of query 210 is NO (FALSE) indicating that the system has not yet reached the minimum flicker change defined by the user, then method 200 proceeds to query 212 wherein it is determined whether or not the flicker decreased in magnitude. If the outcome of query 212 is YES (TRUE) indicating that the adjustment in $V_{COM}$ provided in step 206 produced a decrease in the flicker magnitude, then method 200 returns to ADJUST VCOM step 206 where $V_{COM}$ is changed again in the same direction as before. This loop continues until the outcome of query 210 is YES (TRUE). If the outcome of query 212 is NO (FALSE) indicating that the magnitude of the flicker did not decrease when $V_{COM}$ was adjusted in the first direction, then method 200 proceeds to step 214 wherein the direction of the change in $V_{COM}$ is reversed. For example, if the initial ADJUST VCOM direction in step 204 is to make $V_{COM}$ larger then in step 214, the direction of change in step 204 is reset to now make $V_{COM}$ smaller, or vice versa. After step 214, method 200 returns to ADJUST VCOM step 206 but now with the opposite direction or polarity of change in $V_{COM}$ and the cycle is repeated until a YES (TRUE) outcome is obtained from query 210. When the outcome of query 210 is YES (TRUE) then method 200 proceeds to optional query 216 wherein it is determined whether the magnitude of flicker is less than a predetermined threshold F1 stored in memory 80. This query is useful for dealing with a possible case, depending upon the shape of the flicker versus $V_{COM}$ relationship, where for large values of flicker F greater than F1, an incremental change $V_{COM}$ may not produce a significant change in flicker. So, if the outcome of query 216 is NO (FALSE) indicating that such a regime has been encountered, method 200 returns to query 217 and repeats the loop until $\Delta F \leq \epsilon$ and $F < F1$, that is, until a YES (TRUE) outcome is obtained from both queries 210 and 216. Then method 200 advances to step 218 wherein $V_{COM}$ is set to the last value, that is, the value that produces a YES (TRUE) outcome from both queries 210 and 216. Method 200 then returns to start 202 an initial step 204. The result of method 200 is to dynamically drive display system 40, 40', 70 to operate with minimum display flicker within the accuracy set by the minimum flicker change parameter $\epsilon$. Persons of skill in the art will understand based on the description herein how to choose an appropriate value of $\epsilon$ depending upon the physical properties of their display system and the desired dynamic response speed or cycle time. While it is convenient to dynamically minimize display flicker by adjusting $V_{COM}$, this is not the only way to accomplish this. Based on the description herein, persons of skill in the art will understand that the effective $V_{COM}$ may be changed by determining a new set of Gamma voltages and that the flicker can be minimized by adjusting the asymmetry of the AC drive and/or by adjusting $V_{COM}$ or both. These approaches are also useful.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A liquid crystal display having compensation for varying brightness levels, comprising:

a dimmable back-light configured to provide varying brightness levels;

a display panel, optically coupled to the back-light for receiving illumination therefrom, and whose properties depend upon the varying back-light brightness levels and having a first input configured to receive a compensating signal proportional to the varying back-light levels, the first input coupled to a common terminal of the display panel adapted to receive a common voltage;

an electrical circuit configured to receive back-light brightness level information that is proportional to an ambient light level;

a non-volatile memory configured to store values of an optimum display panel compensating signal as a function of back-light brightness levels; and a controller coupled to the memory, the electrical circuit and the display panel, the controller configured to retrieve from the memory the optimum display panel compensating signal corresponding to the back-light brightness level received from the electrical circuit, and transmit such optimum display panel compensating signal to the first input.

2. The display of claim 1, wherein output of the dimmable back-light can be varied over a dimming range of approximately 2 to 1 or greater.

3. The display of claim 1, wherein output of the dimmable back-light can be varied over a dimming range of up to at least 50,000 to 1.

4. The display of claim 1, wherein the display panel further comprises thin film transistors that are photosensitive.

5. The display of claim 1, wherein the dimmable back-light comprises light emitting diodes.

6. The display of claim 1, wherein the electrical circuit comprises a back-light lamp driver and the back-light brightness information is proportional to a light producing drive signal provided to the back-light by the back-light lamp driver.

7. The display of claim 1, wherein the electrical circuit comprises a photodetector in a light path of the back-light.

8. A method for compensating a liquid crystal display for varying display brightness level, comprising:

reading a brightness value that varies over time in proportion to a sensed ambient light level;

determining a display compensating signal value corresponding to the read brightness value; and automatically applying the display compensating signal value to the display by sending a value proportional to the display compensating signal to a common electrode of the display.

9. The method of claim 8, wherein determining comprises, retrieving from a look-up table, the compensating signal corresponding to the read brightness value.

10. The method of claim 8, wherein reading comprises, measuring an actual brightness value of a back-light optically coupled to the display.

11. The method claim 8 including: reading a brightness value that varies over time in proportion to the projected image size.

12. A liquid crystal display having compensation for varying brightness levels, comprising:

a dimmable back-light configured to provide varying back-light brightness levels in proportion to sensed ambient light intensities;

a display panel, optically coupled to the back-light and configured to receive illumination therefrom, and whose flicker properties depend upon the varying back-light brightness level, and having a first input for receiving a compensating signal;

an electrical circuit for receiving a real time flicker level of the display panel and the sensed ambient light intensities; and a controller coupled to the electrical circuit and the display panel, the controller configured to receive from the electrical circuit a signal related to both the display flicker level and the sensed ambient light intensities and configured to determine based thereon a display panel compensating signal corresponding to the observed flicker level and transmit such display panel compensating signal to the first input.

13. The display of claim 12, wherein the electrical circuit comprises a sensor optically coupled to the display panel and electrically coupled to the controller, and adapted to measure the real-time flicker level of the display panel and provide such information to the controller.

14. The display of claim 13, wherein the sensor is integrated with the display panel.

15. A method for compensating a liquid crystal display for varying display brightness level, comprising:

electronically measuring the real time display flicker and a brightness value that varies over time in proportion to an ambient light level;

electronically determining a display compensating signal value that varies with the measured display flicker; and automatically applying the display compensating signal value to an input of the display for receiving a common electrode voltage to reduce said flicker.

16. The method of claim 15, wherein the compensating signal is applied to Gamma voltages of the display, effectively changing $V_{COM}$.

17. The method of claim 15, further comprising prior to the determining step, evaluating whether the real time display flicker obtained in the measuring step has changed.

18. The method of claim 15, further comprising prior to the measuring step, illuminating the display with light obtained from an LED back-light source.

* * * * *